US011725490B2

(12) United States Patent
Bisset et al.

(10) Patent No.: US 11,725,490 B2
(45) Date of Patent: Aug. 15, 2023

(54) GAS LIFT SIDE POCKET MANDREL WITH MODULAR INTERCHANGEABLE POCKETS

(71) Applicant: Baker Hughes Oilfield Operations LLC, Houston, TX (US)

(72) Inventors: Stephen Bisset, Porter, TX (US); Tyler Shirk, Houston, TX (US); Donavan Brown, Houston, TX (US)

(73) Assignee: Baker Hughes Oilfield Onerations LLC, Houston, TX (US)

( * ) Notice: Subject to any disclaimer, the term of this patent is extended or adjusted under 35 U.S.C. 154(b) by 0 days.

(21) Appl. No.: 17/524,445

(22) Filed: Nov. 11, 2021

(65) Prior Publication Data

US 2022/0145735 A1 May 12, 2022

Related U.S. Application Data

(60) Provisional application No. 63/112,561, filed on Nov. 11, 2020.

(51) Int. Cl.
*E21B 43/12* (2006.01)
*E21B 23/03* (2006.01)

(52) U.S. Cl.
CPC ..... *E21B 43/123* (2013.01); *E21B 23/03* (2013.01)

(58) Field of Classification Search
CPC ..... E21B 43/123; E21B 23/03
See application file for complete search history.

(56) References Cited

U.S. PATENT DOCUMENTS 2,144,833 A * 1/1939 Crickmer ..... E21B 43/123 417/115
2,649,272 A 8/1953 Barbato
2,845,940 A * 8/1958 Garrett ..... E21B 43/123 251/145
2,942,671 A 6/1960 Josephine
3,160,113 A * 12/1964 Meyers ..... E21B 43/123 417/115
3,646,953 A 3/1972 Elliott et al.
(Continued)

FOREIGN PATENT DOCUMENTS

EP 2666957 A2 11/2013
WO 2004031529 A2 4/2004
(Continued)

OTHER PUBLICATIONS

Schlumberger , "Side Pocket Mandrels—Reliable Gas Lift with Flexibility for the Future; 17-AL-291763", Jan. 1, 2017.
(Continued)

*Primary Examiner* — Jonathan Malikasim
(74) *Attorney, Agent, or Firm* — Crowe & Dunlevy, P.C.

(57) ABSTRACT

A side pocket mandrel for use within a gas lift system is configured to permit the exchange of valve pockets. The side pocket mandrel has a central body, a receiver that is laterally offset from the central body, and a valve pocket that is removably secured to the receiver. The valve pocket can be configured for a threaded connection with the receiver to permit the facilitated exchange of modular valve pockets at the receiver. Gas from the valve pocket can be carried to the central body of the side pocket mandrel through one or more external gas lines or one or more internal gas injection passages.

19 Claims, 4 Drawing Sheets

(56) References Cited

U.S. PATENT DOCUMENTS

| | | | | |
|---|---|---|---|---|
| 3,654,949 | A * | 4/1972 | McMurry | E21B 43/123 417/112 |
| 3,863,961 | A * | 2/1975 | Dinning | E21B 23/01 403/322.2 |
| 3,874,445 | A | 4/1975 | Terral | |
| 3,888,273 | A | 6/1975 | Douglas | |
| 4,033,409 | A | 7/1977 | Hebert | |
| 4,135,576 | A | 1/1979 | Tausch | |
| 4,146,091 | A | 3/1979 | Terral | |
| 4,265,306 | A | 5/1981 | Stout | |
| 4,295,795 | A | 10/1981 | Gass et al. | |
| 4,295,796 | A | 10/1981 | Moore | |
| 4,333,527 | A | 6/1982 | Higgins et al. | |
| 4,437,487 | A * | 3/1984 | Marmon | F16K 27/07 251/339 |
| 4,505,331 | A | 3/1985 | Akkerman | |
| RE32,441 | E | 6/1987 | Higgings et al. | |
| 4,685,523 | A | 8/1987 | Paschal et al. | |
| 4,759,410 | A | 7/1988 | Benker et al. | |
| 5,176,164 | A | 1/1993 | Boyle | |
| 5,181,566 | A * | 1/1993 | Barneck | E21B 17/18 166/117.5 |
| 5,535,767 | A | 7/1996 | Schnatzmeyer et al. | |
| 5,971,004 | A | 10/1999 | Pringle | |
| 6,070,608 | A | 6/2000 | Pringle | |
| 6,148,843 | A | 11/2000 | Pringle | |
| 6,206,645 | B1 | 3/2001 | Pringle | |
| 6,375,155 | B1 | 4/2002 | Janssens | |
| 6,679,332 | B2 | 1/2004 | Vinegar et al. | |
| 6,715,550 | B2 | 4/2004 | Vinegar et al. | |
| 6,722,632 | B2 | 4/2004 | Kenny et al. | |
| 7,213,607 | B2 | 5/2007 | De | |
| 9,057,243 | B2 | 6/2015 | Hendel et al. | |
| 9,453,397 | B2 | 9/2016 | Dowling et al. | |
| 9,453,398 | B1 | 9/2016 | Zhang et al. | |
| 10,655,439 | B2 | 5/2020 | Murdoch et al. | |
| 10,677,028 | B2 | 6/2020 | Oliphant | |
| 10,787,889 | B2 | 9/2020 | Salihbegovic et al. | |
| 2001/0017157 | A1 | 8/2001 | Pringle | |
| 2002/0020533 | A1 | 2/2002 | Tubel | |
| 2007/0181312 | A1 | 8/2007 | Kritzler et al. | |
| 2007/0227739 | A1 | 10/2007 | Becker et al. | |
| 2013/0146155 | A1 | 6/2013 | Gilbertson et al. | |
| 2013/0220599 | A1 | 8/2013 | Rae | |
| 2020/0011155 | A1 | 1/2020 | Stamm et al. | |
| 2020/0032592 | A1 * | 1/2020 | Romer | E21B 43/121 |

FOREIGN PATENT DOCUMENTS

| | | | |
|---|---|---|---|
| WO | 2014022121 | A1 | 2/2014 |
| WO | 2016049726 | A1 | 4/2016 |
| WO | 2020212726 | A1 | 10/2020 |

OTHER PUBLICATIONS

Schlumberger , "SO2-30R-B Dual-Check Shear Orifice Gas Lift Valve", Schlumberger; SO2-30R-B Dual-Check Shear Orifice Gas Lift Valve; 2011, Jan. 1, 2011.

Schlumberger , "WRFC-H Wireline-retrievable flow control valve for gas lift applications", Schlumberger; WRFC-H Product Brochure; 09-CO-0263; 2010, Jan. 1, 2010.

ISA/US; Search Report and Written Opinion for PCT/US2021/058973 dated Apr. 1, 2022.

"MMRG Series Side Pocket Mandrels", Schlumberger, MMRG Series Side Pocket Mandrels, Sales Brochure, 2015.

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

* cited by examiner

GAS LIFT SIDE POCKET MANDREL WITH MODULAR INTERCHANGEABLE POCKETS

RELATED APPLICATIONS

This application claims the benefit of U.S. Provisional Patent Application Ser. No. 63/112,561 entitled "Gas Lift Side Pocket Mandrel with Modular Interchangeable Pockets," filed Nov. 11, 2020, the disclosure of which is herein incorporated by reference.

FIELD OF THE INVENTION

This invention relates generally to the field of oil and gas production, and more particularly to a gas lift system that incorporates an improved gas lift module.

BACKGROUND

Gas lift is a technique used to improve the production of hydrocarbons from a subterranean reservoir through a tubing string disposed in a well. Gaseous fluids are injected into the tubing string from the surrounding annulus in the well to reduce the density of the produced fluids within the tubing string to allow the formation pressure to push the less dense mixture to the surface. The gaseous fluids are typically injected into the annulus from the surface.

A series of gas lift valves allow access from the annulus into the production tubing. The gas lift valves can be configured to automatically open when the pressure gradient between the annulus and the interior of the production tubing exceeds the closing force holding each gas lift valve in a closed position. The gas lift valves are typically housed in one or more gas lift mandrels, which are connected to the tubing string. In most installations, each of the gas lift mandrels within the gas lift system is deployed above a packer or other zone isolation device to ensure that liquids and wellbore fluids do not interfere with the operation of the gas lift valve. Increasing the pressure in the annular space above the packer will force the gas lift valves to open, thereby injecting pressured gases into the production tubing.

To permit the unimpeded production of wellbore fluids through the production tubing, the gas lift valves are housed within "side pockets" of the gas lift mandrels (sometimes referred to as "side pocket mandrels") in which the valve pocket is laterally offset from the production tubing. Because the gas lift valves are contained in these laterally offset valve pockets, tools can be deployed and retrieved through the open primary passage of the side pocket mandrel. The predetermined position of the gas lift valves within the production tubing string controls the entry points for gas into the production string.

Although existing gas lift systems have found broad commercial success, currently available side pocket mandrels are expensive and complicated to manufacture. The components must be precisely welded to ensure proper performance of the side pocket mandrel. Furthermore, because the valve pocket is permanently affixed within the side pocket mandrel, the gas lift valves must be selected to match the pockets available within the side pocket mandrels. This presents a potential supply chain limitation if the only available gas lift valves are improperly sized for the side pocket mandrels in a particular well. There is, therefore, a need for an improved gas lift system that overcomes these and other deficiencies in the prior art.

SUMMARY OF THE INVENTION

In one aspect, the present disclosure is directed to a side pocket mandrel for use within a gas lift system. The side pocket mandrel has a central body, a receiver that is laterally offset from the central body, and a valve pocket that is removably secured to the receiver.

In another aspect, the present disclosure is directed to a gas lift module for use within a gas lift system deployed in a well. The gas lift module includes a side pocket mandrel and a pup joint connected to the side pocket mandrel. The side pocket mandrel includes a central body, a receiver that is laterally offset from the central body, and a valve pocket that is removably secured to the receiver. A gas lift valve is releasably secured within the valve pocket using latch mechanisms.

In yet another aspect, the present disclosure is directed to a method for exchanging a valve pocket on a gas lift module, where the gas lift module includes a central body, a receiver that is laterally offset from the central body, a first valve pocket that is connected to the receiver, and a first gas lift valve contained within the first valve pocket. The method includes the steps of removing the first valve pocket from the receiver, installing a second valve pocket onto the receiver, and installing a second gas lift valve into the second valve pocket. In some embodiments, the step of installing the second valve pocket onto the receiver includes the step of threading the second valve pocket onto the receiver.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells.

Figure 1:
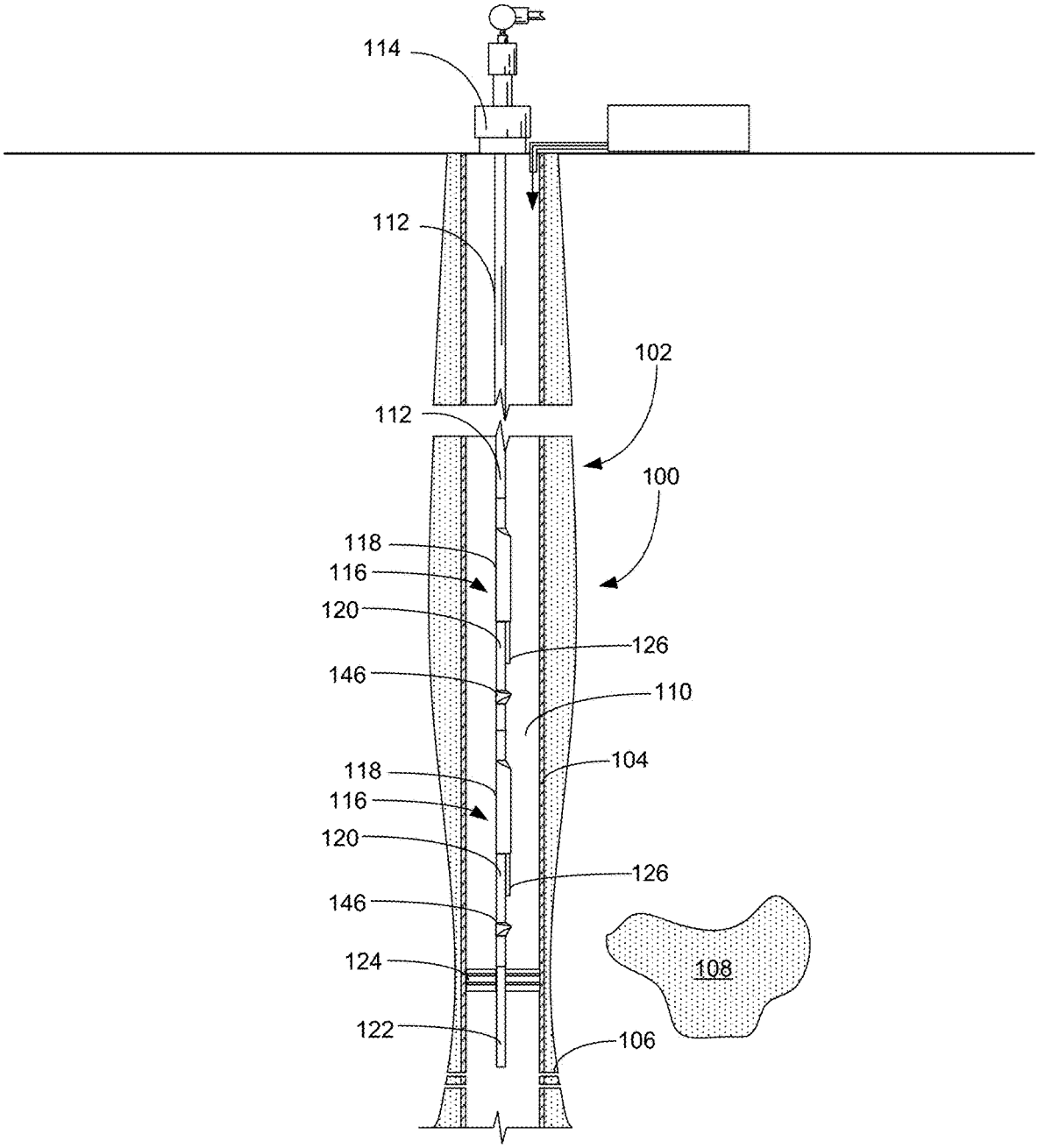
FIG. 1 is a side view of a gas lift system deployed in a conventional well.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annular space 110 is formed between the gas lift system 100 and the casing 104. The gas lift system 100 is connected to production tubing 112 that conveys produced wellbore fluids from the formation 108, through the gas lift system 100, to a wellhead 114 on the surface.

The gas lift system 100 includes one or more gas lift modules 116. The gas lift modules 116 each include a side pocket mandrel 118, which may be connected to a pup joint 120. An inlet pipe 122 extends through one or more packers 124 into a lower zone of the well 102 closer to the perforations 106. In this way, produced fluids are carried through the inlet pipe 122 into the lowermost (upstream) gas lift module 116. The produced fluids are carried through the gas lift system 100 and the production tubing 112, which conveys the produced fluids through the wellhead 114 to surface-based storage or processing facilities.

In accordance with well-established gas lift principles, pressurized fluids or gases are injected from the surface into the annular space 110 surrounding the gas lift system 100. When the pressure gradient between the annular space 110 and the production tubing 112 exceeds a threshold value, the gas lift modules 116 admit the pressurized gases into the production tubing 112 through the side pocket mandrel 118. The pressurized gases combine with the produced fluids in the gas lift modules 116 to reduce the overall density of the fluid, which facilitates the recovery of the produced fluids from the well 102. The gas lift system 100 may find utility in recovering liquid and multiphase hydrocarbons, as well as in unloading water and water-based fluids from the well 102.

Figure 2:
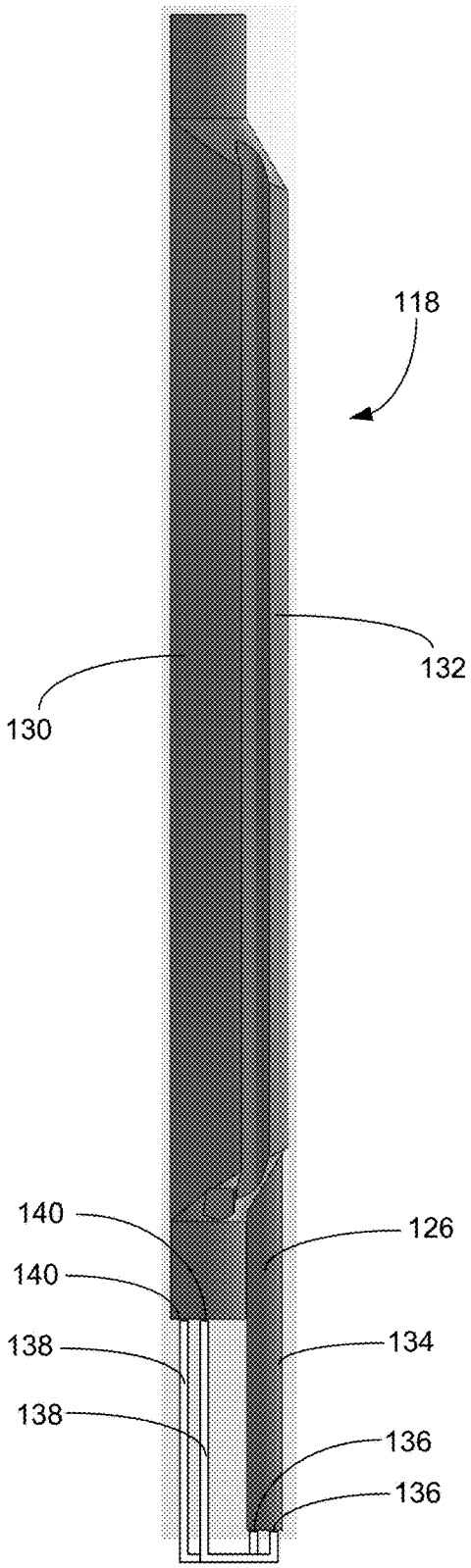
FIG. 2 is a side view of a side pocket mandrel constructed in accordance with an embodiment of the invention.
Figure 3:
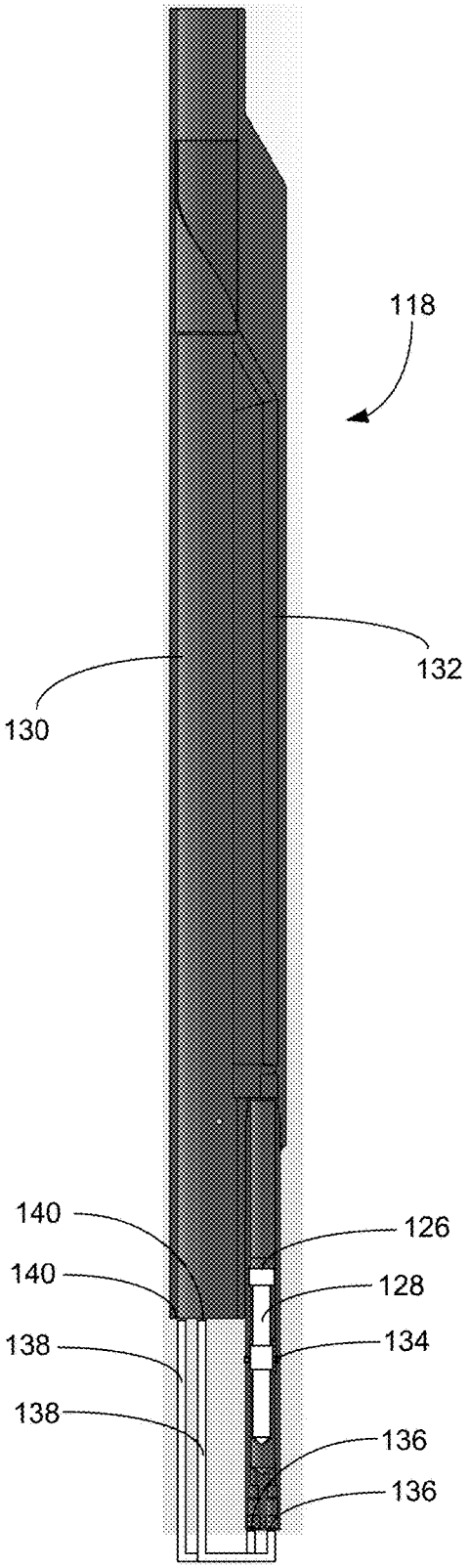
FIG. 3 is a cross-sectional depiction of the side pocket mandrel of FIG. 2.
Figure 4:
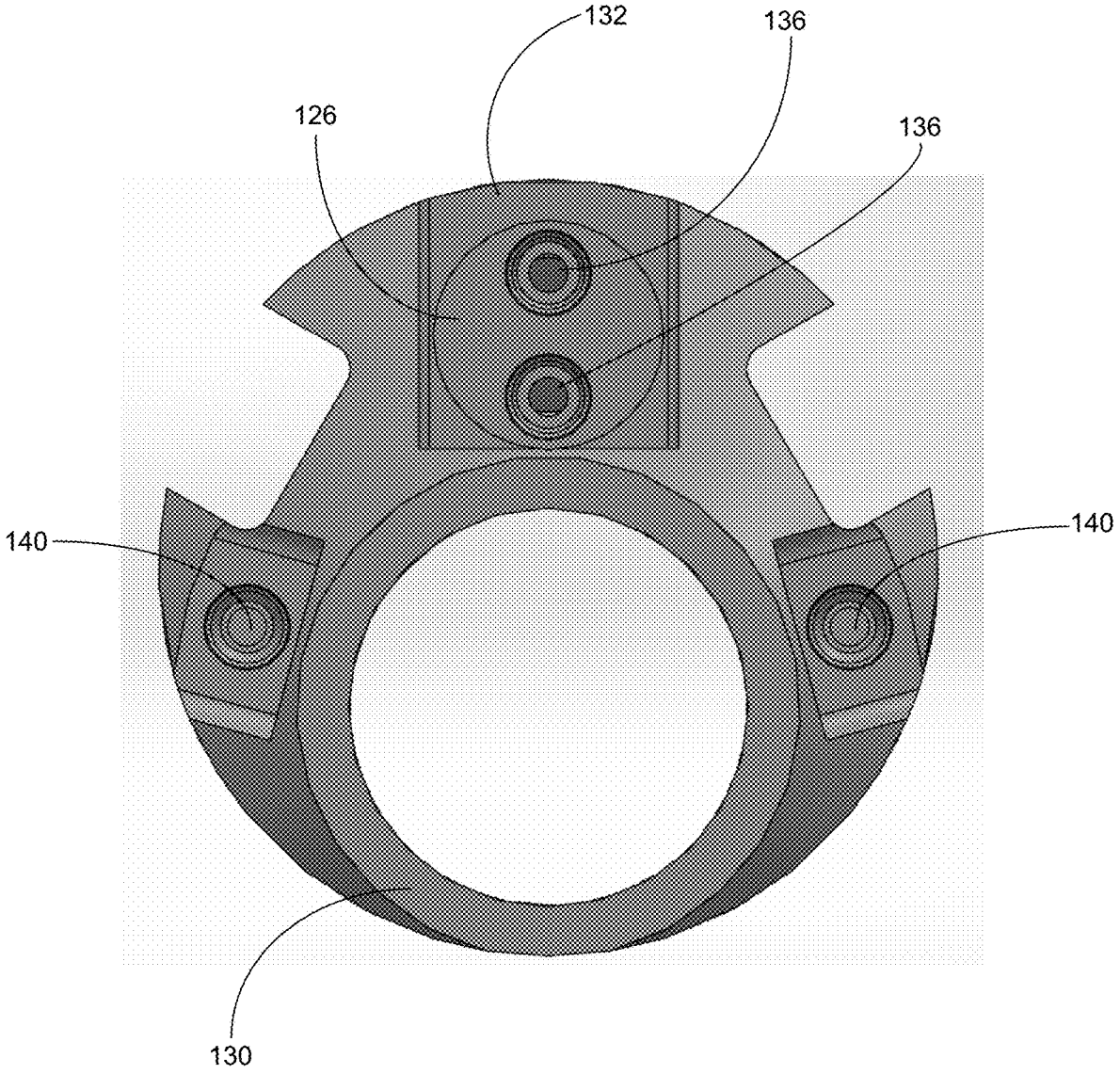
FIG. 4 is a lower end view of the side pocket mandrel of FIG. 2.
Figure 5:
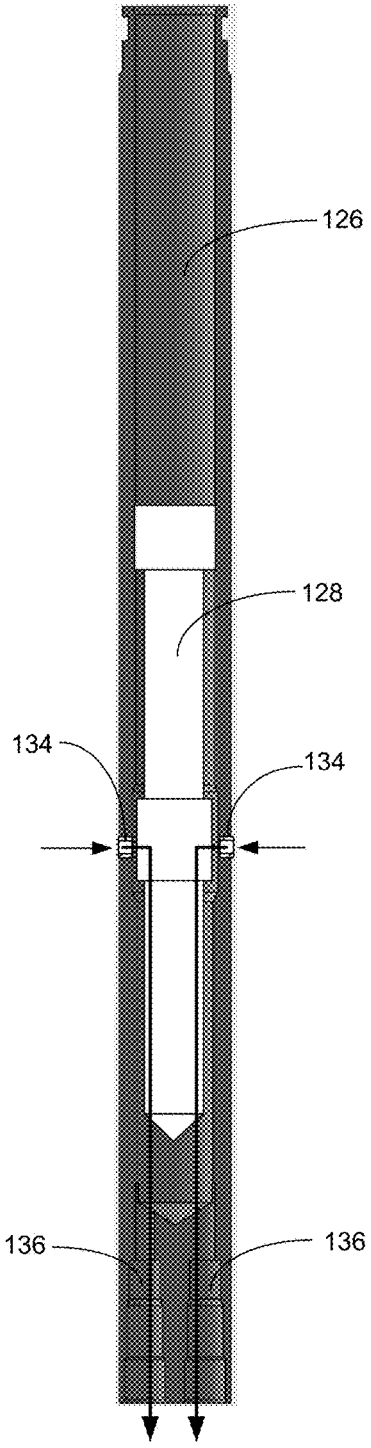
FIG. 5 is a cross-sectional view of the valve pocket of FIG. 2, illustrating the placement of the gas lift valve.
Figure 6:
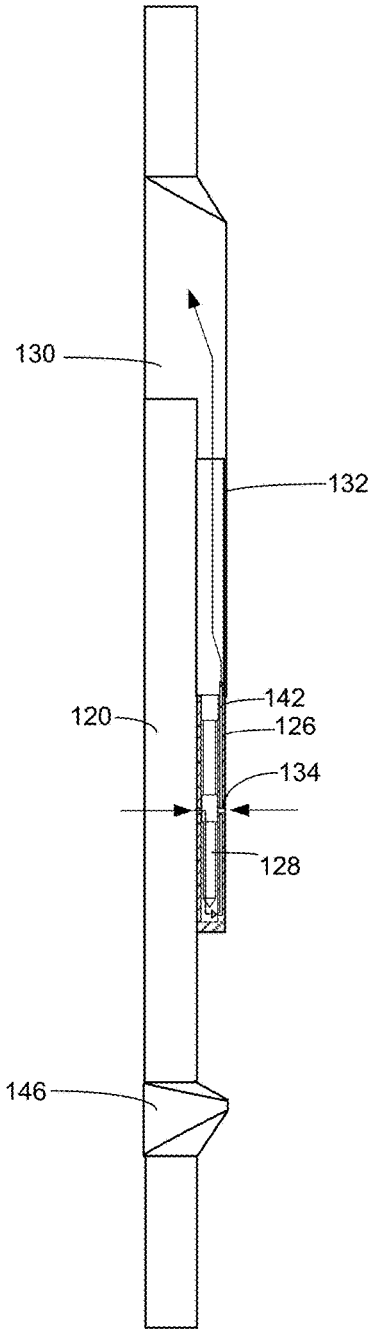
FIG. 6 is a partial cross-sectional view of an embodiment of the side pocket mandrel with an internal gas passage.

Turning to FIGS. 2-7, shown therein are various depictions of the gas lift module 116. As depicted in FIGS. 2-3, the gas lift module 116 includes an exchangeable valve pocket 126 that is configured to contain a retrievable gas lift valve 128. Unlike prior art gas lift modules in which the valve pocket is integral with the side pocket mandrel, the valve pocket 126 of the gas lift modules 116 constructed in accordance with exemplary embodiments of the present invention is detachable from the side pocket mandrel 118. In this way, the valve pocket 126 is modular in that a variety of different valve pockets 126 can be installed within a given gas lift module 116. This permits an operator to swap valve pockets 126 on a particular side pocket mandrel 118 to accommodate different gas lift valves 128 or to provide different performance characteristics.

Figure 7:
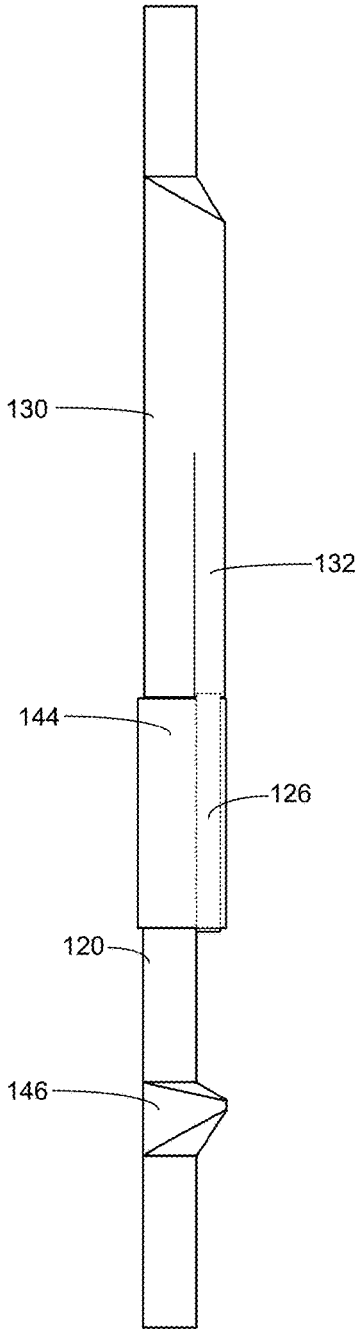
FIG. 7 is a side view of an embodiment of the side pocket mandrel with an external guard over the valve pocket.

As depicted in the cross-sectional views of FIG. 3 and FIG. 7, the side pocket mandrel 118 includes a central body 130 in substantial alignment with the production tubing 112, and a receiver 132 that is laterally offset from the central body 130. The central body 130 and receiver 132 each include internal fluid passages that are connected within the side pocket mandrel 118. The side pocket mandrel 118 may include an internal orientation sleeve 133 (shown in FIG. 3) that is configured to interact with a "kickover" tool for installing and removing a gas lift valve 128 within the offset receiver 132. The valve pocket 126 and valve 128 can include latching mechanisms (e.g., "RA" and "RK" latches) for securing the gas lift valve 128 within the valve pocket 126.

A proximal end of the valve pocket 126 can be secured to the receiver 132 of the side pocket mandrel 118 with a threaded connection. In other embodiments, the proximal end of the valve pocket 126 is captured within the receiver 132 with a high pressure concentric snap fitting. In the exemplary embodiments, the valve pocket 126 is configured to be installed or removed from the receiver 132 at the surface. This presents a significant advancement over prior art systems because it allows the gas lift module 116 to be easily adapted to accept gas lift valves 128 of different sizes by connecting the appropriately sized valve pocket 126 within the receiver 132.

If, for example, the operator would like to run a 1.5" gas lift valve 128 in a side pocket mandrel 118 that was originally configured to accept a 1" gas lift valve 128, the operator can install a valve pocket 126 that will accept the larger 1.5" gas lift valve 128 without replacing the entire side pocket mandrel 118. The interchangeable nature of the valve pocket 126 and receiver 132 also permits the installation of valve pockets 126 of varying length, which may be helpful if additional components are to be housed inside the valve pocket 126.

For applications where the maximum outer diameter of the side pocket mandrel 118 is limited by the inner diameter of the casing 104, it may be useful to replace a first valve pocket 126 having a first outer diameter and a first length with a second valve pocket 126 that has roughly the same outer diameter, but a second length that is longer than the first length to accommodate a longer gas lift valve 128 with additional inlet ports 134 and outlet ports 136 to increase the gas flow rate through the gas lift valve 128. The opposite exchange is also contemplated within the scope of exemplary embodiments. A longer valve pocket 126 can be replaced with a shorter valve pocket 126, which may have a larger or smaller outer diameter depending on the space available within the casing 104.

Continuing with the embodiment depicted in FIGS. 2-5, the valve pocket 126 includes inlet ports 134 and outlet ports 136. The inlet ports 134 admit pressurized fluid from the annular space 110 to the gas lift valve 128. When the gas lift valve 128 opens, the pressurized gas is carried out of the valve pocket 126 through the outlet ports 136. Gas lines 138 are connected between the outlet ports 136 and intake ports 140 on the central body 130 of the side pocket mandrel 118. In the alternative embodiment depicted in FIG. 6, the valve pocket 126 includes one or more internal gas injection passages 142 that direct pressurized gas to pass upward through the valve pocket 126 and receiver 132 to the central body 130 rather than through the external gas lines 138. In some applications, it may be desirable to use both external gas lines 138 and internal gas injection passages 142.

Because conventional side pocket mandrels are expensive and difficult to manufacture, the modular, exchangeable design of the side pocket mandrel 118 reduces cost and minimizes supply chain constraints by allowing the same side pocket mandrel 118 to be easily reconfigured in remote locations to accommodate a variety of gas lift valves 128. The use of the exchangeable valve pocket 126 simplifies the manufacturing process because the valve pocket 126 can be manufactured separately and then fitted to the receiver 132 with a threaded or quick coupling connection. This removes the need for complicated and difficult welding or machining procedures that are expensive and prone to error.

To protect the valve pocket 126 during installation of the gas lift module 116, the valve pocket 126 can be secured to the central body 130 or pup joint 120 with a cover 144 (FIG. 7). The cover 144 surrounds the valve pocket 126 to shield the valve pocket 126 from impact with objects in the well 102. Additionally, or alternatively, a projection 146 can be installed on the pup joint 120 or central body 130 below the distal end of the valve pocket 126. The projection 146 extends away from the pup joint 120 to an extent that shields the valve pocket 126 from contact with the casing 104, downhole equipment, or debris as the gas lift module 116 is run into the well 102.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A side pocket mandrel for use within a gas lift system, the side pocket mandrel comprising:
- a central body;
- a receiver that is laterally offset from the central body;
- a valve pocket that is removably secured within the receiver; and
- a gas lift valve contained within the valve pocket, wherein the gas lift valve can be installed or removed from the valve pocket with a kickover tool.

2. The side pocket mandrel of claim 1, wherein the valve pocket is removably secured to the receiver with a threaded connection.

3. The side pocket mandrel of claim 1, wherein the valve pocket is removably secured to the receiver with a high pressure concentric snap fitting.

4. The side pocket mandrel of claim 1, wherein the valve pocket comprises:
- inlet ports that admit pressurized gas to the gas lift valve; and
- outlet ports that carry pressurized gas from the gas lift valve.

5. The side pocket mandrel of claim 4, wherein the central body includes intake ports and wherein external gas lines connect the intake ports on the central body to the outlet ports on the valve pocket.

6. The side pocket mandrel of claim 1, wherein the valve pocket comprises:
- inlet ports that admit pressurized gas to the gas lift valve; and
- one or more internal gas injection passages that carry the pressurized gas from the gas lift valve to the central body.

7. The side pocket mandrel of claim 1, wherein the side pocket mandrel further comprises a cover that protects the valve pocket.

8. A gas lift module for use within a gas lift system deployed in a well, the gas lift module comprising:
- side pocket mandrel comprising:
  - a central body;
  - a receiver that is laterally offset from the central body;
  - a valve pocket that is removably secured to the receiver; and
  - a gas lift valve releasably secured within the valve pocket; and
- a pup joint connected to the central body.

9. The gas lift module of claim 8, wherein the valve pocket is removably secured to the receiver with a threaded connection.

10. The gas lift module of claim 8, wherein the valve pocket is removably secured to the receiver with a high pressure concentric snap fitting.

11. The gas lift module of claim 8, wherein the valve pocket comprises:
- inlet ports that admit pressurized gas to the gas lift valve;
- outlet ports that carry pressurized gas from the gas lift valve.

12. The gas lift module of claim 11, wherein the central body includes intake ports and wherein the gas lift module includes external gas lines that connect the intake ports on the central body to the outlet ports on the valve pocket.

13. The gas lift module of claim 8, wherein the valve pocket comprises:
- inlet ports that admit pressurized gas to the gas lift valve; and
- one or more internal gas injection passages that carry the pressurized gas from the gas lift valve to the central body.

14. The gas lift module of claim 8, wherein the gas lift module further comprises a projection on the pup joint below the receiver, wherein the projection is configured to shield the valve pocket as the gas lift module is lowered into the well.

15. A method for exchanging a first valve pocket for a second valve pocket on a side pocket mandrel of a gas lift module, the method comprising the steps of:
- providing a receiver within the gas lift module, wherein the first valve pocket is installed in the receiver and wherein the first gas lift valve is installed in the first valve pocket;
- removing the first gas lift valve from the first valve pocket;
- removing the first valve pocket from the receiver;
- installing the second valve pocket into the receiver; and
- installing a second gas lift valve into the second valve pocket.

16. The method of claim 15, wherein the step of removing the first valve pocket from the receiver further comprises unthreading the first valve pocket from the receiver.

17. The method of claim 15, wherein the step of installing the second valve pocket into the receiver further comprises threading the second valve pocket into the receiver.

18. The method of claim 15, wherein the step of installing the second gas lift valve into the second valve pocket occurs before the step of installing a second valve pocket onto the receiver.

19. The method of claim 15, further comprising the step of connecting external gas lines between outlet ports on the second valve pocket and intake ports on central body of the gas lift module.

* * * * *